US006139241A

United States Patent [19]

Craig et al.

[11] Patent Number: 6,139,241

[45] Date of Patent: Oct. 31, 2000

[54] MULTI-FACETED MODULAR SILO FOR BULK SOLIDS

[75] Inventors: David Anthony Craig, Boston; Thomas Anthony Royal, North Andover, both of Mass.

[73] Assignee: Jenike & Johanson, Inc., Westford, Mass.

[21] Appl. No.: 09/398,959

[22] Filed: Sep. 16, 1999

[51] Int. Cl.[7] ..... E04H 7/22; B65G 3/04; B65D 88/64; B65D 88/02

[52] U.S. Cl. ..... 414/287; 52/192; 52/197; 52/79.3; 52/79.7; 222/564; 239/379

[58] Field of Search ..... 414/287, 919; 52/192, 197, 79.3, 79.2, 79.7, 236.4; 222/564, 328, 185.1; 239/379

[56] References Cited

U.S. PATENT DOCUMENTS

| | | | |
|---|---|---|---|
| 1,542,380 | 6/1925 | Foster | 414/287 X |
| 2,007,683 | 7/1935 | Kreutzer | 52/192 X |
| 2,897,926 | 8/1959 | Hawthorne | 52/197 |
| 3,071,297 | 1/1963 | Lee | 222/462 |
| 3,081,009 | 3/1963 | Cooper | 222/564 X |
| 3,327,870 | 6/1967 | Fairchild, Jr. | 211/183 |
| 3,391,832 | 7/1968 | Weislehner | 222/564 X |
| 3,512,321 | 5/1970 | Boatner | 52/197 |
| 3,797,707 | 3/1974 | Jenike et al. | 222/193 |
| 3,921,351 | 11/1975 | Johnson | 52/197 |
| 4,180,186 | 12/1979 | Alphandary | 406/152 |
| 4,428,507 | 1/1984 | Sneider | 222/105 |
| 4,600,125 | 7/1986 | Maynard, Jr. | 222/81 |
| 4,795,266 | 1/1989 | Johanson | 366/341 |
| 5,235,787 | 8/1993 | Bloxsom et al. | 52/79.3 |
| 5,884,437 | 3/1999 | Olsen | 52/79.7 X |
| 5,934,522 | 8/1999 | Canela et al. | 222/564 X |
| 5,992,699 | 11/1999 | Johnson et al. | 222/185.1 |

FOREIGN PATENT DOCUMENTS

| | | |
|---|---|---|
| 201507 | 1/1959 | Austria . |
| 6600862 | 7/1967 | Netherlands . |
| 36177 | 3/1950 | Poland . |
| 628273 | 10/1978 | U.S.S.R. . |
| 838081 | 6/1981 | U.S.S.R. . |

OTHER PUBLICATIONS

Paper, L. Bates, "Solids Flow Generation and Control," 1998, pp. 1–13 *Institution of Chemical Engineers*.

*Primary Examiner*—Robert P. Olszewski
*Assistant Examiner*—Gerald J. O'Connor
*Attorney, Agent, or Firm*—Lahive & Cockfield, LLP

[57] ABSTRACT

A silo for gravity flow storage of bulk particulate solids comprises downwardly converging and downwardly diverging walls. The downwardly converging walls form angles to the vertical that satisfy the conditions for mass flow. The walls impose particle velocity gradients in the horizontal cross sections of the silo, reducing interparticle cohesion, preventing the formation of arches and promoting uniformity of residence time within the silo. The modules may be vertically stacked, and may be clustered to increase capacity and to reduce pressure stress levels where required.

21 Claims, 6 Drawing Sheets

MULTI-FACETED MODULAR SILO FOR BULK SOLIDS

BACKGROUND OF THE INVENTION

This invention relates generally to gravity flow storage silos, vessels, bins and the like, for bulk particulate solids. More particularly, the invention relates to silos used in material handling processes that require a uniform residence time of material in a silo. Examples of such processes include purging of volatiles from bulk solid particles, and curing of particles from one bulk state to another state.

A principal object of the invention is to provide a gravity flow silo that achieves uniform residence time of the particles in the sense that if a thin horizontal layer of bulk solid particles is placed on the top free surface of material in the silo and discharged, all of the particles that constituted such layer will exit the silo at substantially the same time.

A second object of the invention is to provide a silo producing relative interparticle motion throughout its volume for reasons which will be evident from the following description.

A third object of the invention is to provide a silo causing mass flow of the solids. By mass flow it is meant that all of the material is in motion whenever any material is withdrawn from the silo. With mass flow, material from the periphery as well as the center moves toward the outlet. Advantages of mass flow include the achievement of a first-in/first-out flow sequence, the elimination of stagnant, nonmoving material, the reduction of sifting segregation, the provision of a steady discharge with a consistent bulk density, and a flow that is uniform and well controlled.

Mass flow is distinguished from funnel flow, wherein an active flow channel forms above the outlet of the silo, with non-flowing material at the periphery. As the level of material in the silo decreases, layers of non-flowing material may or may not slide into the flowing channel which can result in the formation of stable ratholes. In addition, funnel flow can cause product caking, can provide a first-in/last-out flow sequence, and can increase the extent to which sifting segregation occurs in the discharging material.

A typical prior art silo for use where a uniform residence time is required is a vertical cylinder to which a converging hopper is affixed. It is known that within a tall, slender, vertical cylinder, except for localized conditions at the bottom caused by the hopper, all particles move at a constant velocity with no relative interparticle motion. This is characterized as rigid body motion. However, without relative interparticle motion some bulk solids form a stable cohesive arch at the transition, that is, the intersection between the cylinder and the hopper sections. Gravity flow of the solids then ceases. The formation of such cohesive arches at the intersection is often due to strong bonds that form between individual bulk material particles as they flow down through the cylinder section. If these bonds develop sufficient strength in the time required to flow through the cylinder, then the material may arch at the transition. Whether the bulk solid particles form sufficient strength to produce an arch is a function of the material in question and the residence time of the material in the cylinder. Increasing the size (diameter or width) of the cylinder section to reduce the propensity of the material to arch may not be possible in many cases, particularly those in which there is a requirement for a uniform residence time of all particles within the silo.

Soviet Union Patent No. 628273 issued to Vladimir Polytechnic Institute describes a silo (with inserts) for dry, free flowing materials. The inserts are comprised of converging and diverging pyramids. Vertical side walls enclose the pyramids. Both the converging and diverging surfaces have slits cut into them, with the diverging pyramid having square openings cut into the flat walls at the base of the section. These slits and square openings allow the free flowing bulk solid to pass from within the converging and diverging sections, into the outer region formed by the vertical silo walls and the pyramids. The material is also allowed to flow from the outer region, back into the pyramid sections. If the material is cohesive in nature (i.e., not free flowing), the material is likely to form arches over the slits and square openings, thus rendering gravity flow through the walls of the pyramids impossible.

By its very nature, the design with square openings at the base of the diverging pyramid sections will create dead zones of material. This implies that mass flow of material within the silo will not result. Furthermore, the design will create large velocity differentials on a horizontal slice of material (these differentials will also vary as a function of level within the silo), thereby resulting in a non-uniform residence time.

BRIEF SUMMARY OF THE INVENTION

With the above stated objects in view, including the avoidance of arching, funnel flow and other drawbacks of prior art silos, the features of this invention include a silo structure comprising downwardly converging and downwardly diverging walls. The downwardly converging walls form angles to the vertical that satisfy the conditions for mass flow. The walls impose relative interparticle motion at every horizontal cross section, which assists in the elimination of arching. The basic silo wall elements may be formed into modules that may be used singly or in multiple vertically stacked configurations to form the silo. Such vertical configurations may be used singly or in multiple clusters. Silos in any such forms may be attached to suitable hopper configurations, either directly or through vertical transitional sections that minimize particle velocity differentials within the converging/diverging structure.

The foregoing and other features of the invention are described and will be evident from the following description of presently preferred embodiments.

DETAILED DESCRIPTION

Figure 1:
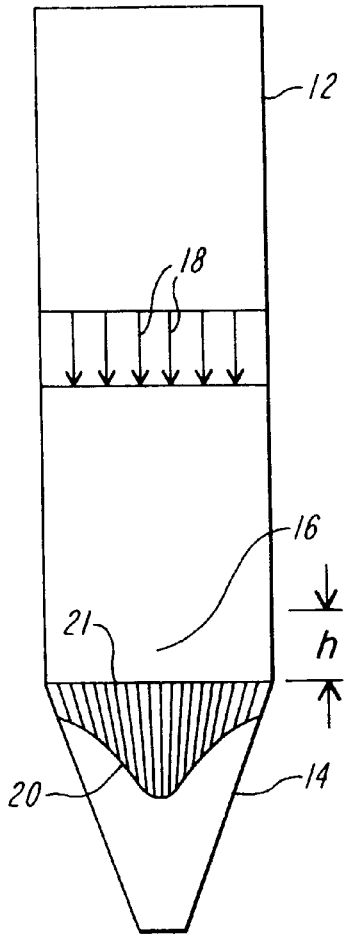
FIG. 1 (PRIOR ART)
FIG. 1 is a partially diagrammatic elevation of a prior art cylinder silo fitted with a conical hopper.

FIG. 1 illustrates a prior art gravity flow silo comprising a cylindrical section 12 and a conical hopper section 14. It is well known that except for a transitional region 16 all bulk solid particles move in the cylinder at the same velocity under gravity flow, as diagrammatically represented by velocity vectors 18 of equal length over the horizontal cross section. It is also well known that at any horizontal cross section within the hopper 14 the particles nearer the central axis move downward with greater velocity than those nearer the hopper walls as represented by velocity vectors 20 of variable length. This is true for hoppers having mass flow. Within the transitional region 16 this velocity differential established at the top of the hopper section propagates upwardly into the cylindrical section and gradually attenuates to zero at a height "h" determined by the geometry of the silo and the material properties of the particles.

In the silo of FIG. 1, if it is required that there be a uniform residence time, then the hopper section 14 must be minimized in volume because of the velocity differential that is inherent in this geometry, while the vertical cylinder 12 should have a volume and height-to-diameter ratio that are maximized. A tall, slender cylinder is therefore preferred. However, as above noted, such configurations also fail in use for certain processes due to the formation of arches at the transition 21 between the cylinder and the hopper.

FIGS. 2 to 5 illustrate structures according to a first embodiment of the invention. Four elements 22, 24, 26 and 28 of similar construction are shown. The element 22 is typical and comprises two flat, downwardly converging walls 30 and 32 and two flat, downwardly diverging walls 34 and 36, the walls being joined at their edges so that the cross sections of the element 22 are rectangular from the top to the bottom extremity. The converging walls 30 and 32 each form an angle $\theta$ with the vertical. The diverging walls 34 and 36 each form an angle $\alpha$ with the vertical. Preferably, each of the elements 24, 26 and 28 is formed of four walls in the same manner as the element 22. The elements are vertically stacked with their adjoining walls connected to form complete annular peripheral closures.

In the embodiment shown the sides of the downwardly converging walls 30 and 32 arc of equal length A at their upper extremities and of equal length B at their lower extremities. The sides of the downwardly diverging walls 34 and 36 are of equal length B at their upper extremities and equal length A at their lower extremities. The elements 22 and 24 stacked together comprise a module 38. In this configuration the element 24 is rotated 90° about the axis of symmetry of the silo relative to the element 22. This stacking arrangement may be used singly or stacked with a similar module 40, or a greater number of modules, with the rotation of the elements repeated. A single element such as 22 or any odd or even number of stacked elements such as 22 may be used to form a silo.

It is well known in the art that to ensure mass flow in a hopper the downwardly converging walls must be sufficiently smooth and steep to promote flow at the walls. The same criterion applies to the described embodiment. Specifically, the downwardly converging walls must form an angle $\theta$ that is equal to or smaller than the empirically determined mass flow angle of the solids. Angles less than this critical value may be used and still provide mass flow, with the benefit that small angles produce reduced velocity differentials of the particles moving within any given horizontal cross section. Those skilled in the art are able to determine an appropriate angle $\theta$ for the particular bulk solid.

The angle of divergence $\alpha$, that is, the angle to the vertical formed by the downwardly diverging walls such as 34 and 36, is preferably chosen to be equal to $\theta$, although this is not an absolute requirement. When $\theta=\alpha$ the cross sectional areas of the top and bottom openings of each element such as 22 are equal, thus promoting a uniform residence time when the element is used to form a silo either alone, in combination with another element such as 24, or in multiple modules 38, 40.

The minimum outlet width A of the silo is preferably determined by the flow characteristics of the particular bulk solid. It is chosen so that neither a cohesive nor a mechanical arch will form. The determination of the other dimensions of the elements will reflect other considerations such as the level of material induced flow stresses in each element of the silo and the residence time requirements as well as the flow stress field in each channel with converging and diverging walls.

Figure 2:
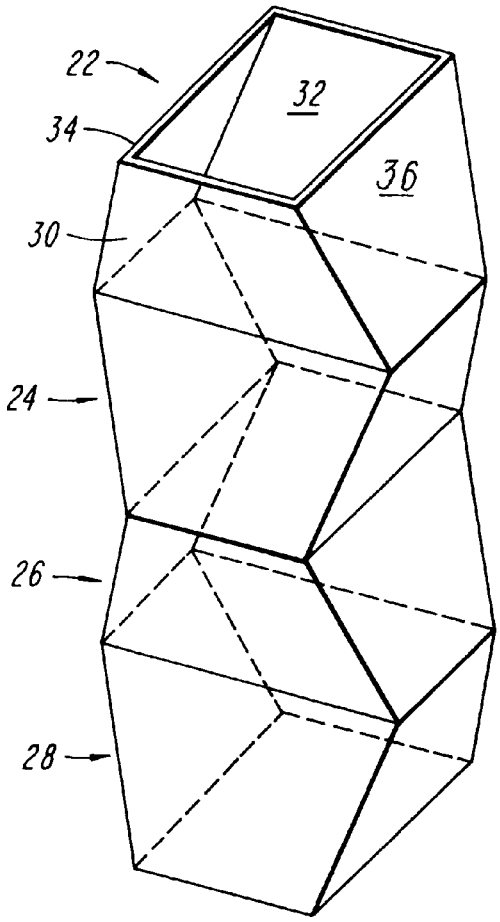
FIG. 2 is an oblique view of a silo comprising two modules according to a first embodiment of the invention.
Figure 3:
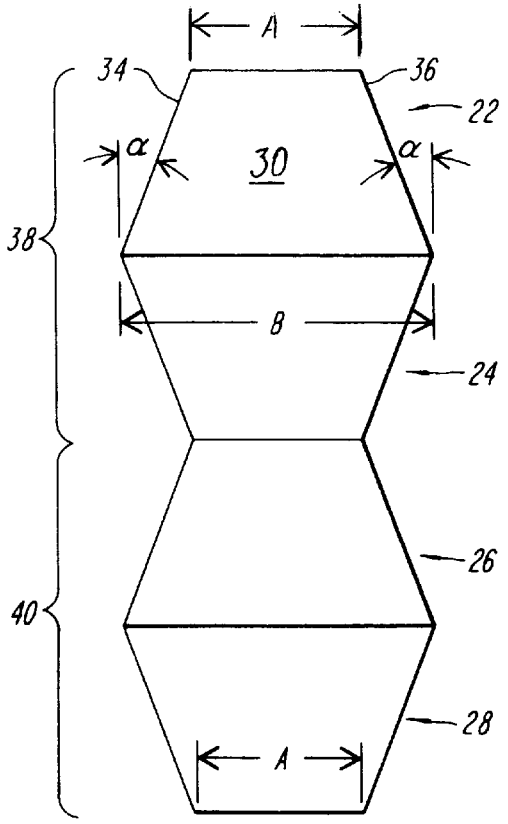
FIG. 3 is a front elevation of the silo of FIG. 2.
Figure 4:
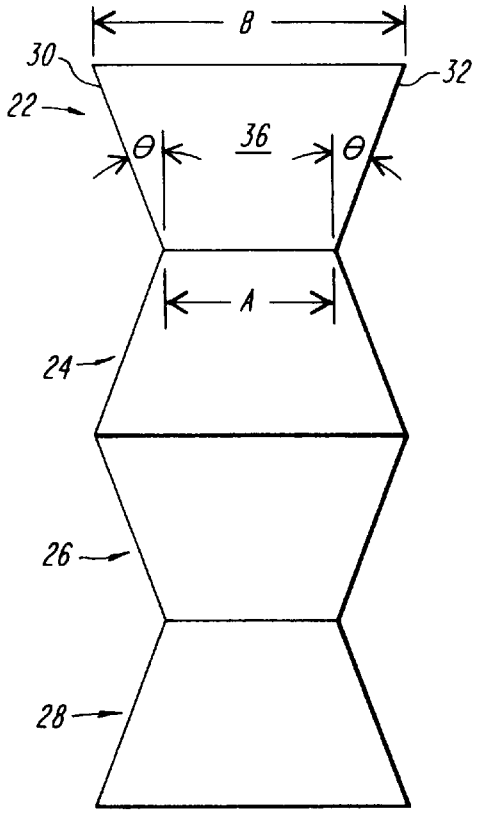
FIG. 4 is a right side elevation of the silo of FIG. 2.
Figure 5:
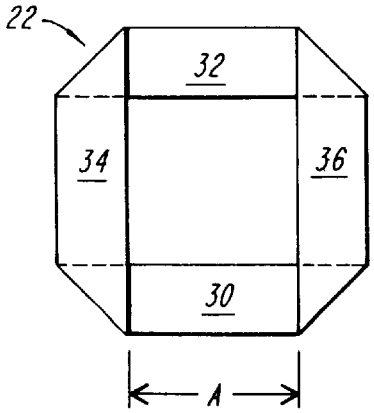
FIG. 5 is a top plan view of the silo of FIG. 2.

In the embodiment of FIG. 2, if the areas of the top and bottom of each element are equal or nearly so, the average velocities of all moving particles are substantially the same, thus promoting a uniform residence time in the silo. Also, the particles move in mass flow and relative interparticle motion exists throughout the silo.

As illustrated in FIGS. 2–5, the silo provides a flow channel that may be discharged either by unrestricted gravity flow or by means of a feeder. If a conventional feeder is used to control the discharge rate, the capacity of the feeder must increase along its length in the direction of discharge.

Figure 8:
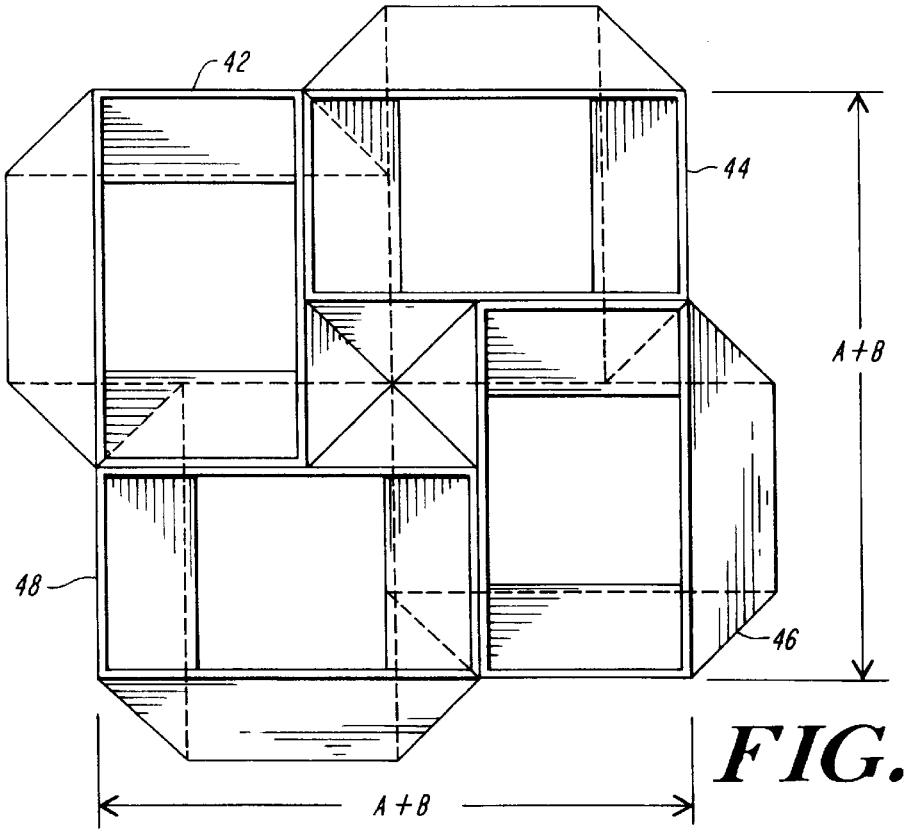
FIG. 8 shows a fourth embodiment comprising multiple clustered silos, each similar to the first embodiment.
Figure 9:
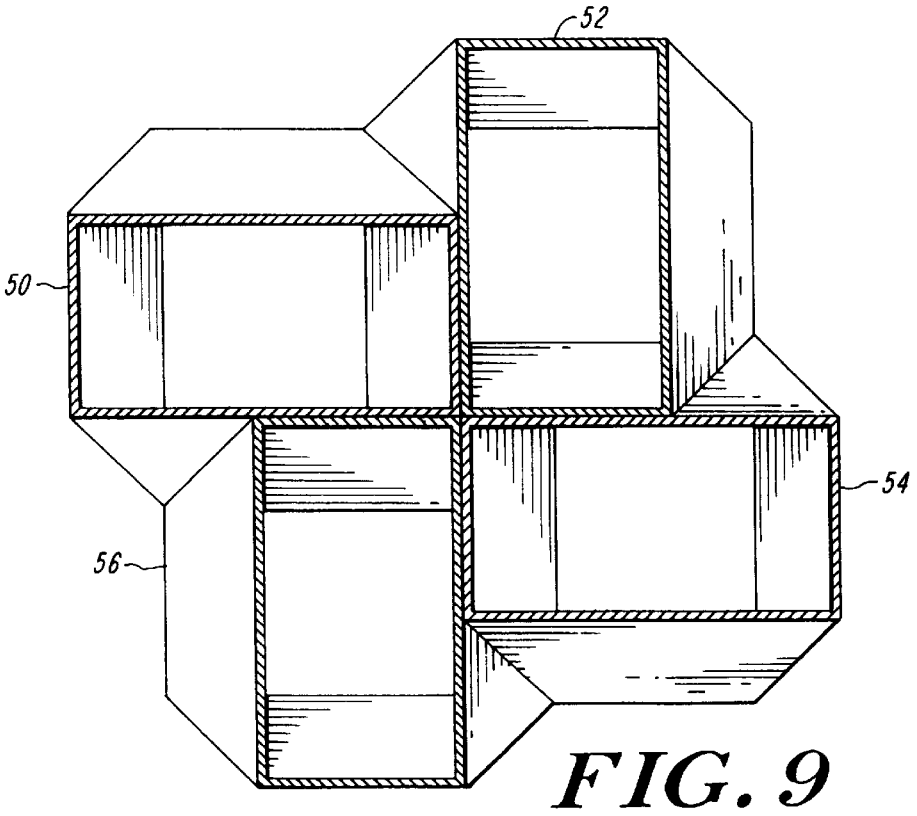
FIG. 9 illustrates a fifth embodiment showing a variation of the cluster arrangement.

In some cases the bulk solid storage capacity requirements dictate the use of a silo having a large cross sectional area. However, as the physical size of the silo increases, the stress level in the flowing bulk solid also increases. This stress level may be detrimental by causing unwanted particle attrition, product degradation or other undesired results. In particular, the stress may result in an increase in the strength of the material, promoting its propensity to form an arch. One means to avoid this problem is to employ clusters comprising multiple silos of the form shown in FIGS. 1 to 5. This is illustrated by FIGS. 8 and 9. In FIG. 8 silos 42, 44, 46 and 48, all of the form shown in FIG. 2, are clustered and nested so that they form a square opening with side dimensions A+B at the top and bottom, forming convenient shapes for attachment of square shaped filling and discharging apparatus. In FIG. 9 silos 50, 52, 54 and 56 of similar construction are clustered in an alternative configuration.

Figure 6:
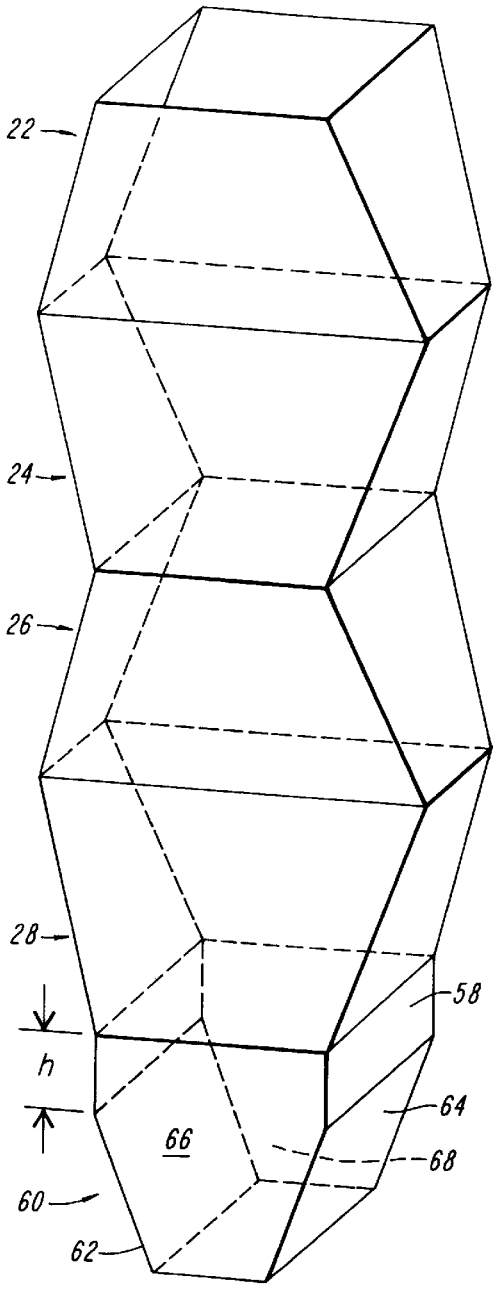
FIG. 6 shows a second embodiment comprising the embodiment of FIG. 2 fitted with a converging hopper.

In some applications the outlet dimensions of the silo of FIG. 2 or of clustered silos as in FIGS. 8 and 9 are larger than practicable to feed a downstream process. In this case a converging mass flow hopper section is attached to the silo as illustrated in FIGS. 6, 7 and 10–12. Referring to FIG. 6, the silo of FIG. 2 is connected to a structure having an upper section 58 with four vertical walls, and a wedge-shaped hopper 60 comprising two downwardly sloping walls 62 and 64 and two vertical walls 66 and 68. The walls 62 and 64 form angles with the vertical that are equal to or smaller than the critical mass flow angle for the solids. It will be evident that mass flow hoppers of other converging shapes may be employed in the alternative, and they may converge to slotted, round, oval or other shaped outlets.

The purpose of the vertical section 58 relates to the fact that, as noted above, the geometry of the converging hopper imposes velocity gradients on the particles within any horizontal cross section, the particles closer to the axis of symmetry moving faster than those nearer the sloping walls 62 and 64. On the other hand, it is desirable that all of the particles moving through the silo above the vertical section 58 shall move at the same average velocity, without reference to their positions relative to the axis of symmetry. The velocity gradient in the cross section at the top of the hopper 60 is propagated upwardly, and the difference between the maximum and minimum velocities within the cross section decreases to zero progressively up to a height "h" at or near the top of the vertical walls. Thus the use of a converging hopper does not propagate a velocity differential into the silo elements that provide a uniform residence time as above described. The height of the vertical section 58 is determined in the same manner as that of the region 16 in FIG. 1, as will be understood by those skilled in the art.

It should be noted that the selection of a suitable hopper geometry and wall surface may in some cases result in a low velocity differential within the hopper, and a relatively small effect on the residence time of particles in the silo measured from the top of the silo to the outlet of the hopper. In such a case the vertical section 58 may be omitted and the hopper may be attached directly to the silo modules of FIG. 2.

Figure 7:
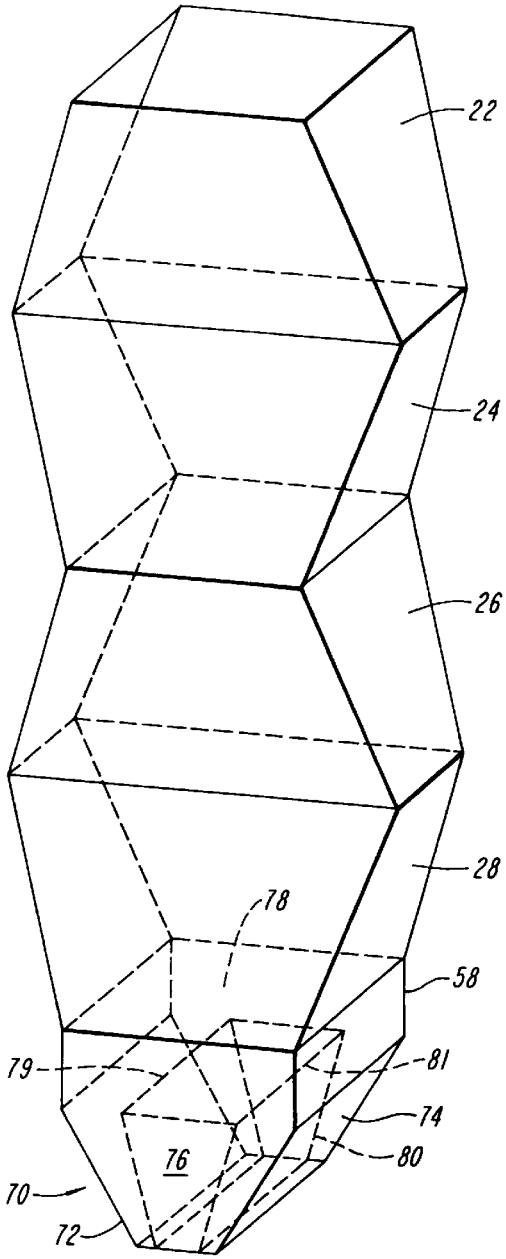
FIG. 7 shows third embodiment comprising the embodiment of FIG. 2 fitted with an outer hopper and an insert to produce mass flow.

FIG. 7 illustrates an embodiment similar to that of FIG. 6 having a modified form of hopper 70 comprising downwardly converging walls 72 and 74 and vertical walls 76 and 78. The angles formed by the walls 72 and 74 and the vertical are greater than the critical mass flow angle for the solids. In this case an insert 80 is provided, having walls 79 and 81 opposing the walls 72 and 74 in accordance with the teachings of Johanson U.S. Pat. No. 4,286,883. In such applications the angles between the opposed walls 72 and 79 and between the opposed walls 74 and 81 are each equal to or smaller than the critical mass flow angle for the solids, and the angles of each of the insert walls 79 and 81 relative to the vertical are also equal to or less than the mass flow angle. The conditions for mass flow are therefore satisfied.

Figure 10:
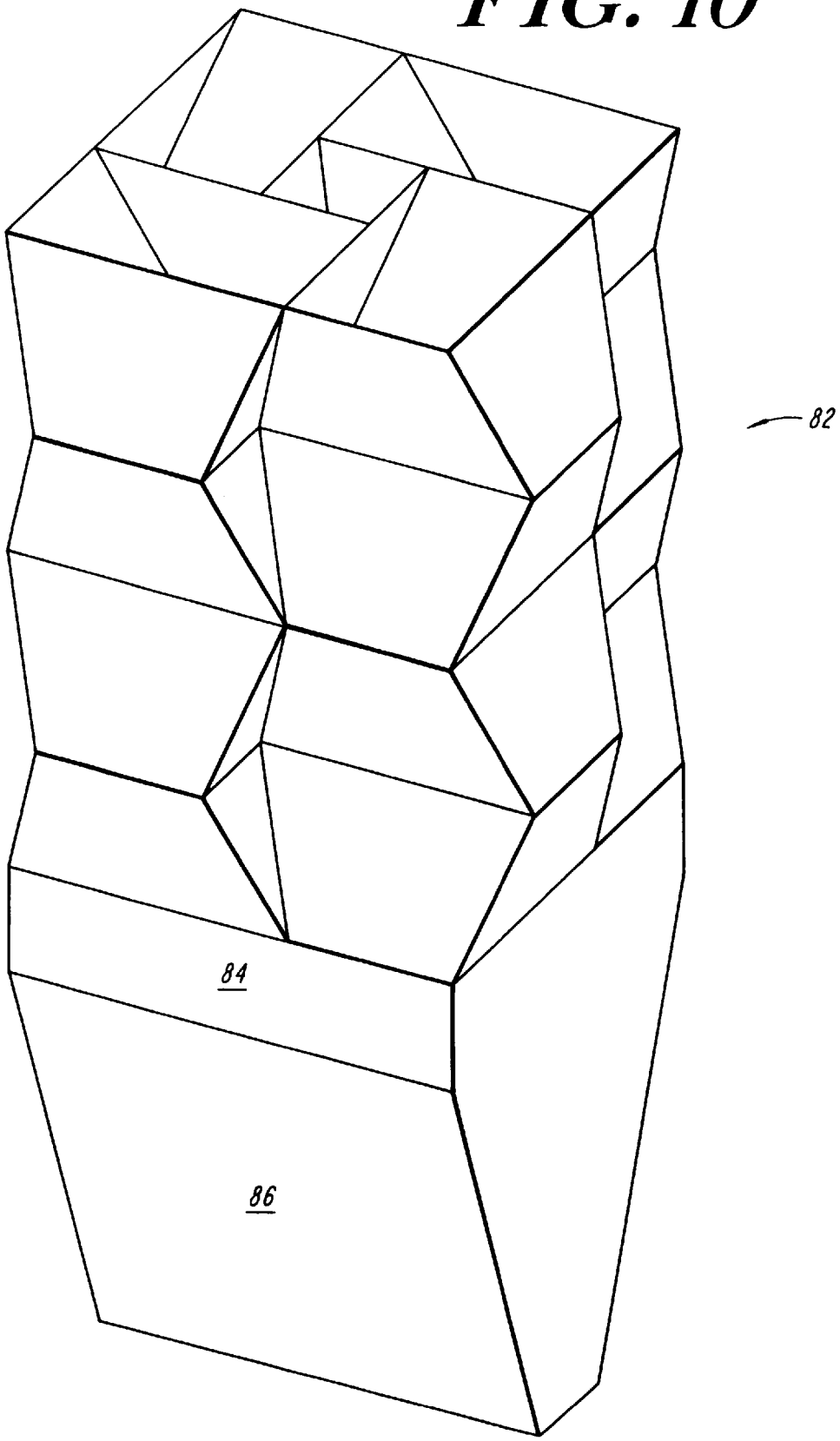
FIG. 10 is an oblique view of the fourth embodiment of FIG. 8 fitted with a converging hopper.

FIG. 10 illustrates a silo comprising the cluster 82 of FIG. 8 attached through a vertical section 84 similar in function to the section 58 of FIG. 6, to a wedge-shaped hopper 86 similar in function to the hopper 60 of FIG. 6.

Figure 12:
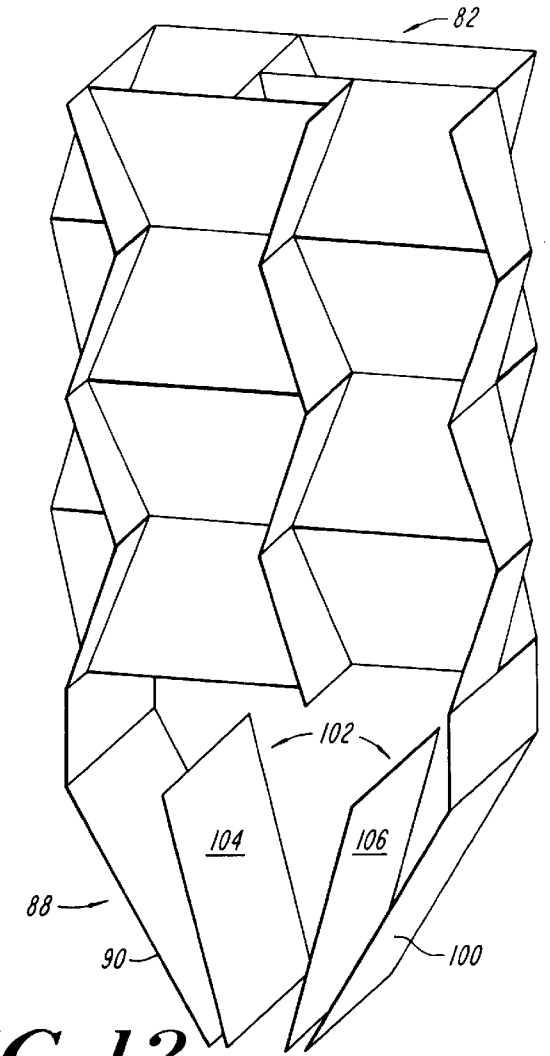
FIG. 12 is another view of the embodiment of FIG. 11 with external silo and hopper walls omitted for purposes of illustration.
Figure 11:
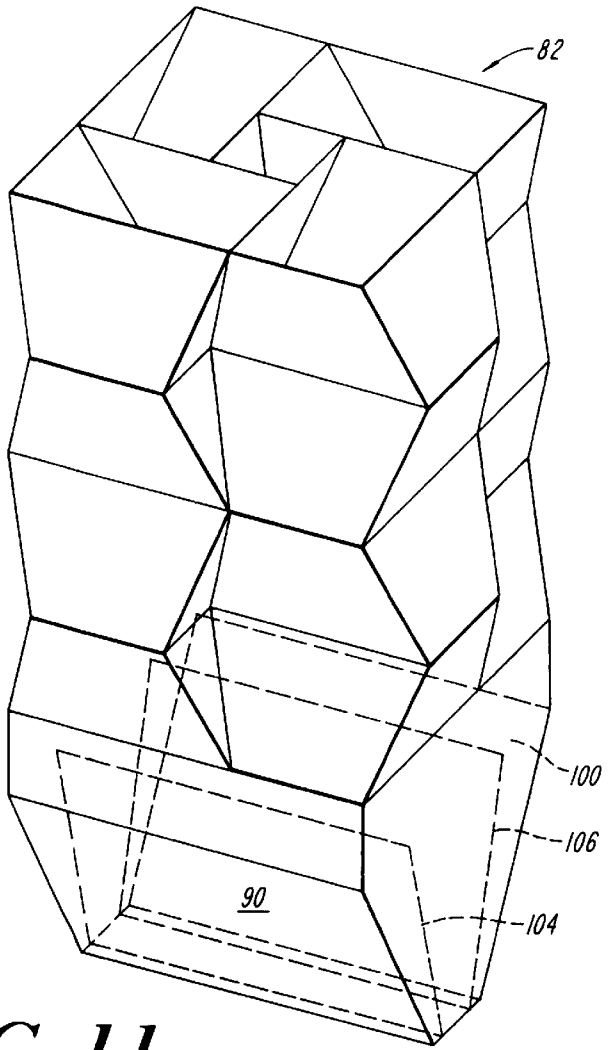
FIG. 11 is an oblique view of the fourth embodiment of FIG. 8 fitted with an outer hopper and an insert.

Similarly, FIGS. 11 and 12 illustrate the cluster 82 attached to a modified hopper 88 similar to the hopper 70 of FIG. 7. FIG. 12 illustrates the same embodiment as FIG. 11 with external walls omitted to show the flow channels of the solids through the silo. Sloping walls 90 and 100 of the hopper form angles to the vertical that are greater than the critical mass flow angle of the solids. An insert 102 having sloping walls 104 and 106 is provided. As in FIG. 7, the angles between the opposed walls 90 and 104 and between the opposed walls 100 and 106 are each equal to or smaller than the critical mass flow angle for the solids, and the angles of each of the insert walls 104 and 106 relative to the vertical are also equal to or less than the mass flow angle. The conditions for mass flow are therefore satisfied.

In the embodiments shown in the drawings the walls that form the converging and diverging sides of each element such as 22 are shown as flat for purposes of description. However, it will be evident to those skilled in the art that in fabrication the comers formed by the walls may be rounded to eliminate sharp internal valleys. Also, the walls may be other than planar in shape, without departing from the spirit or scope of the invention.

What is claimed is:

1. A silo for bulk particulate solids comprising at least one module including an upper element and a lower element, each element comprising downwardly converging and downwardly diverging walls, the downwardly converging walls forming angles to the vertical that are smaller than the critical mass flow angle of the solids, the converging and diverging walls of the upper element being joined to the diverging and converging walls of the lower element respectively, whereby the converging and diverging walls are in vertically alternating sequence.

2. A silo according to claim 1, in which the walls of each element form substantially rectangular cross sections throughout its vertical dimension.

3. A silo according to claim 2, in which the areas of said cross sections are substantially the same at the upper and lower extremities of each element.

4. A silo according to claim 2, in which said cross sections are within a predetermined percent of the same area at the upper and lower extremities of each element.

5. A silo according to claim 1, including a hopper having a converging wall secured to the walls of the lowermost element and forming an angle to the vertical that is smaller than the critical mass flow angle of the solids.

6. A silo according to claim 1, including a hopper having a converging outer wall secured to the walls of the lowermost element and an insert comprising a inner wall opposing and spaced inwardly of the outer wall, the differences between the angles of the respective opposing walls to the vertical being less than the critical mass flow angle of the solids.

7. A silo according to claim 1, including substantially vertical walls having their upper extremities secured to the walls of the lowermost element, and a hopper having a converging wall secured to the lower extremities of the substantially vertical walls and forming an angle to the vertical that is smaller than the critical mass flow angle of the solids.

8. A silo according to claim 1, including substantially vertical walls having their upper extremities secured to the walls of the lowermost element, and a hopper having a converging outer wall secured to the lower extremities of the substantially vertical walls and an insert comprising a inner wall opposing and spaced inwardly of the outer wall, the differences between the angles of the respective opposing walls to the vertical being less than the critical mass flow angle of the solids.

9. A plurality of silos for bulk particulate solids, each silo comprising at least one module including an upper element and a lower element, each element comprising downwardly converging and downwardly diverging walls forming substantially rectangular cross sections throughout its vertical dimension, the downwardly converging walls forming angles to the vertical that are smaller than the critical mass flow angle of the solids, the converging and diverging walls of the upper element being joined to the diverging and converging walls of the lower element respectively, whereby the converging and diverging walls are in vertically alternating sequence, said silos being clustered in side by side relationship with their upper and lower extremities in substantially the same horizontal planes.

10. A plurality of silos according to claim 9, wherein the cross sections thereof at their lower extremities form a square.

11. A plurality of silos according to claim 10, wherein the cross sections thereof at their upper and lower extremities form squares.

12. A plurality of silos according to claim 9, in combination with a hopper having a converging wall secured to the outermost walls of the silos to complete a peripheral closure.

13. The combination of claim 12, in which the walls of the hopper form angles to the vertical that are smaller than the critical mass flow angle of the solids.

14. The combination of claim 12, in which the hopper comprises a converging outer wall secured to the walls of the silos and an inner wall opposing and spaced inwardly of the outer wall, the differences between the angles of the respective opposing walls to the vertical being less than the critical mass flow angle of the solids.

15. A plurality of silos according to claim 9, in combination with substantially vertical walls having their upper extremities secured to the outermost walls of the silos to form a peripheral closure, and a hopper having a converging wall secured to the lower extremities of the substantially vertical walls.

16. The combination of claim 15, in which the wall of the hopper forms an angle to the vertical that is smaller than the critical mass flow angle of the solids.

17. The combination of claim 15, in which the hopper comprises an outer wall secured to the lower extremities of the substantially vertical walls and an inner wall opposing and spaced inwardly of the outer wall, the differences between the angle of the respective opposing walls to the vertical being less than the critical mass flow angle of the solids.

18. A silo for bulk particulate solids comprising a pair of downwardly converging walls forming angles to the vertical that are smaller than the critical mass flow angle of the solids, and a pair of downwardly diverging walls having the sides thereof joined to the sides of the downwardly converging walls in alternating sequence to form an annular enclosure, said enclosure having substantially rectangular horizontal cross sections, the areas of said cross sections being substantially equal at the upper and lower extremities of the silo.

19. A silo according to claim 18, in which the walls are substantially flat.

20. A silo for bulk particulate solids comprising at least two modules, each module including an upper element and a lower element, each element comprising downwardly converging and downwardly diverging walls, the downwardly converging walls forming angles to the vertical that are smaller than the critical mass flow angle of the solids, the converging and diverging walls of the upper element being joined to the diverging and converging walls of the lower element respectively, whereby the converging and diverging walls are in vertically alternating sequence, said modules being vertically stacked.

21. A silo according to claim 20, in which the lowermost extremity of one module is joined to the uppermost extremity of another module to complete a peripheral enclosure.

* * * * *